US007670270B2

(12) United States Patent
Alessandri et al.

(10) Patent No.: US 7,670,270 B2
(45) Date of Patent: Mar. 2, 2010

(54) EXERCISING MACHINE

(75) Inventors: Nerio Alessandri, Longiano (IT); Antonio Cascini, Vimercate (IT); Federico Martini, Ravenna (IT); Simone Casagrande, Rimini (IT)

(73) Assignee: Technogym S.p.A., Gambettola (IT)

( * ) Notice: Subject to any disclaimer, the term of this patent is extended or adjusted under 35 U.S.C. 154(b) by 1392 days.

(21) Appl. No.: 10/674,447

(22) Filed: Sep. 29, 2003

(65) Prior Publication Data

US 2004/0072659 A1 Apr. 15, 2004

(30) Foreign Application Priority Data

Sep. 30, 2002 (IT) ..... RA2002A0017

(51) Int. Cl.
*A63B 21/06* (2006.01)

(52) U.S. Cl. ..... 482/102; 482/92; 482/103

(58) Field of Classification Search ..... 482/83–90, 482/99, 100, 102, 98, 103
See application file for complete search history.

(56) References Cited

U.S. PATENT DOCUMENTS

| | | | | |
|---|---|---|---|---|
| 931,699 | A * | 8/1909 | Medart | 482/102 |
| 4,402,504 | A | 9/1983 | Christian | |
| 5,624,362 | A * | 4/1997 | Wilson | 482/139 |
| 5,928,117 | A * | 7/1999 | Vittone et al. | 482/99 |
| 6,238,323 | B1 | 5/2001 | Simonson | |
| 6,387,020 | B1 | 5/2002 | Simonson | |
| 6,394,935 | B1 | 5/2002 | Lake | |
| 6,422,980 | B1 | 7/2002 | Simonson | |
| 2003/0069112 | A1 * | 4/2003 | Williams | 482/101 |

FOREIGN PATENT DOCUMENTS

| | | |
|---|---|---|
| DE | 4207792 | 9/1993 |
| WO | WO01/66195 A2 | 9/2001 |

* cited by examiner

*Primary Examiner*—Jerome Donnelly
(74) *Attorney, Agent, or Firm*—Abelman, Frayne & Schwab

(57) ABSTRACT

Exercising machine (1) provided with a frame (10) (110) (210) and with at least one operating apparatus (30) (130) (230) which can be used to perform a physical exercise and comprising a load group (15) (115) (215) supported by the frame (10) (110) (210) and connected to the operating apparatus (30) (130) (230) by means of at least one cable (26) (126) (226) wound around a plurality of transmission members (25) (140) (240) supported by the frame (10) (110) (210) and arranged so as to define a path (P) for the cable (26) (126) (226); the load group (15) (115) (215) comprising at least two load units (16, 17) separate from each other and connected together by means of the said cable (26) (126) (226) and arranged at ends of the path (P) on opposite sides of the operating apparatus (30) (130) (230) so that the latter can be tensioned on respective opposite sides by means of different loads.

5 Claims, 3 Drawing Sheets

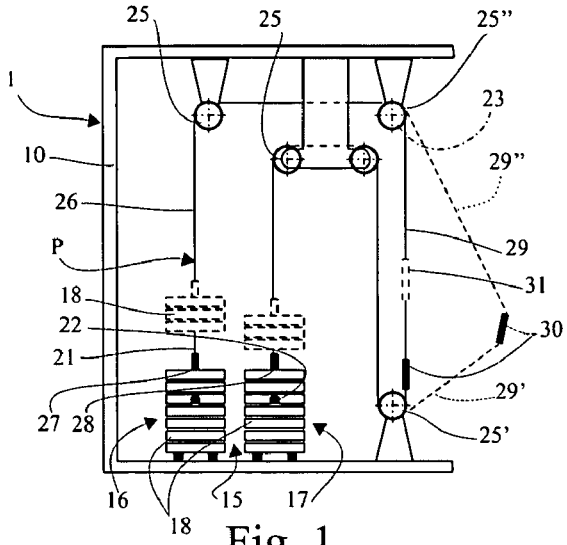
Fig. 1
Fig. 2
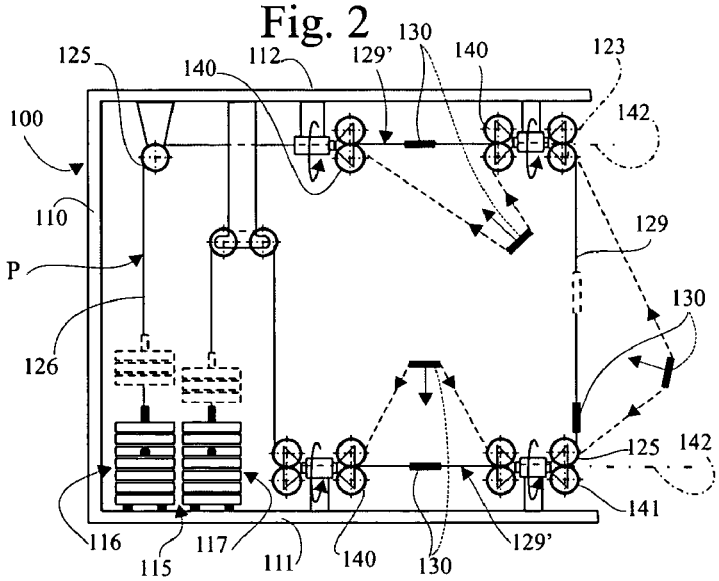
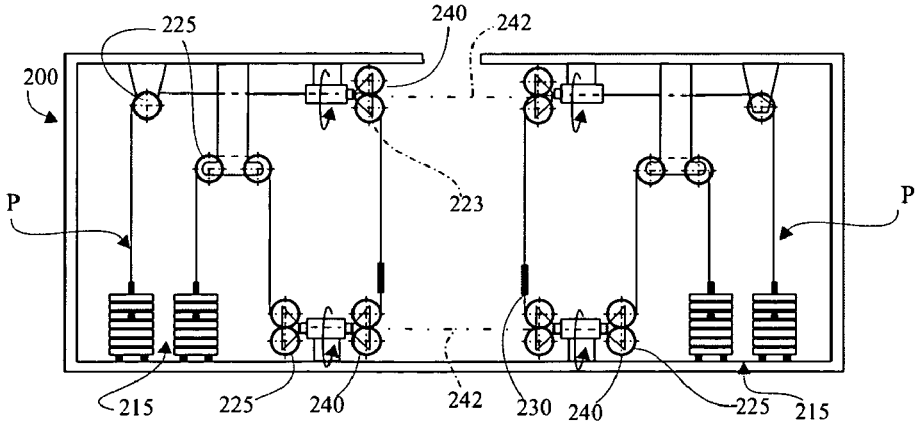
Fig. 3

EXERCISING MACHINE

BACKGROUND OF THE INVENTION

1. Field of the Invention

The present invention relates to an exercising machine for performing muscle training exercises making 5 use of the resistance offered by a load group of a given type.

2. Description of the Prior Art

As is known, the execution of a simple articular movement or athletic action is the result of the balanced activity of at least one pair of muscles, more particularly agonistic muscles, or muscles which tend to cause flexing of the articulation, and antagonistic muscles, or muscles which tend to bring the articulation back into its extended position.

The exercising machines which may be used to perform muscle exercises of an anaerobic type are normally provided with levers or cables by means of which the user interacts with a load unit normally of the gravitational type so that the load model most familiar to users may be reproduced. Hereinbelow, for the sake of brevity, the machines by means of which the user interacts with a load of a varying nature will be referred to simply as "weights machines".

It is likewise known that some weights machines are provided with levers which may be connected to the load directly or indirectly. Leaving aside the former, which are of no interest for illustrating the object and nature of the present invention, the latter very commonly include machines where the user operates the load by means of a cable which is arranged between the load and an operating apparatus with which the user interacts. The cable usually follows a path passing between a plurality of pulleys to each of which a deviation through a particular angle corresponds. Normally the load unit is of the gravitational type and usually comprises a plurality of weights and is normally referred to as "set of weights". Each weight has a given mass and is mounted so as to be slidable axially in a vertical direction by means of a pair of rods. Some of the problems associated with these machines will be illustrated below, it being the aim of the present invention to examine and overcome said problems.

Firstly it must be pointed out that in these cable operated weights machines a translatory movement is imparted to the set of weights selected between a lowered position and a raised position and that the sensation of resistance offered by the set of weights selected for the exercise gradually diminishes as the movement imparted to the operating apparatus reaches completion. When the set of weights nears its highest point, the user experiences a reduction in the force to be overcome, which becomes—3-very evident whenever the user performs a movement which keeps the set of weights at a constant height. It is obvious that, when there is no movement of the resistive load, the user does not perform any work which, as is known, is the product of a force times movement. Therefore, the user is aware, at least for a moment, of an interruption in the muscular exercise. This is the cause of dissatisfaction for an experienced user who is able to recognise his own degree of effort at all times and wishes to maximise it during the whole of the exercise. Normally this type of user prefers not to use single-function weights machines, which exercise just one particular muscle group, and so-called "functional" machines which exercise several muscle groups at the same time. For the sake of clarity, a functional machine is a machine where the operating apparatus, which is connected to the load by means of a cable, allows the user to perform complex articular movements starting from a free posture and therefore simulate activities/movements which are usually performed during the carrying out of any sporting or working activity. The ends of the cable in these machines may be fixed or adjustable spatially. Examples of these machines may be found in the patents U.S. Pat. Nos. 6,238,323, 6,387,020 and 6,422,980.

It should be noted, moreover, that, in cable-operated weights machines, be they of the conventional or functional type, the resistive load always acts tangentially with respect to the limb which is to be exercised by raising the load, and this depends on the fact that the articular movements are obtained by means of a combination of rotational movements, while the cable is a member having a mechanical action only when it is subjected to a pulling force acting along its axis. Therefore, in a cable-operated weights machine, the resistive load applied to a limb by means of a cable will be mainly oriented transversely with respect to the said limb, and the resistance which this load will produce to movement of the limb will always exert a pulling force acting on a given side. Therefore, a cable-operated weights machine reproduces only partially natural conditions where the limbs, when they move in space against the thrust of a load, are subject to combined loads, each of which acts in a given direction.

Moreover it is known that, when it is required to increase the resistance to prolonged effort and not so much the degree of explosive power, it is necessary to perform preferably a large number of repetitions with a low set weight. In cable-operated weights machines it can be easily established that the set of weights is imparted by the user a speed such that it exceeds the energy in its current position and therefore continues to move vertically upwards as a result of inertia, even when the user has completed the agonistic phase of the athletic movement. In the worst of cases, the set of weights at the end of its travel movement, due to inertia, strikes against the upper travel stops of the weight guiding rods and in any case the situation arises—albeit for a very short time interval—whereby the apparatus operated by the user is not subject to any load. At the end of this very short time interval, the load acts again on the operating apparatus suddenly, causing an unpleasant sensation of increased load, which could also be damaging from a physiological point of view, in addition to causing discomfort, in the case where the user has set a large load.

In attempt to overcome the problem of inertia, in some cable-operated weights machines a cam has been mounted along the path of the cable, so as to keep constant the variation in energy of the set of weights during the respective operating movement and thus keep constant the amount of energy required of the user during the course of the exercise. Obviously the installation of this cam, which must be varyingly designed for different types of machine, results in a considerably increase in the cost of the machine. Moreover, it must be mentioned that the addition of this cam is difficult to implement in machines where the operating apparatus consists of a handle which must be gripped by the user, as in the case of so-called pulley-type machines. This type of problem has been examined and partially solved in the above-mentioned patent U.S. Pat. No. 6,238,323, by means of the creation of a multiple-transmission hoist provided with a plurality of pulleys arranged between the set of weights and a final pulley which diverts the cable upstream of the operating apparatus. This final pulley is mounted fixed on the frame of the machine. In this way the operating apparatus and the set of weights are disassociated from each other in terms of speed by a cable, the length of which is at least twice the minimum length required to raise the set of weights by means of the operating apparatus. The consequence of this is that the operating apparatus and the set of weights move constantly at different speeds, the ratio of which depends on the ratio between the actual length of the cable and the minimum length required. The reduction in the speed of the set of weights has the effect of reducing the inertia of the load and hence the different sensation perceived by the user when exercising.

However, even by means of this solution it is not possible to eliminate completely the sensation of lack of load in cable-operated weights machines, among other things because the machines which adopt this solution of increasing the length of the cable must multiply the load by the multiplication factor of the length of the cable in order to keep the value of the resistive load unchanged. It can be easily understood that this solution causes considerable problems in the case, for example, of leg press machines where the load in terms of weights is frequently 250 kg in the case of machines without hoists. In this case doubling of the load would result in machines where the single set of weights has a mass of 500 kg and therefore results in positioning restrictions due to the act that it can be installed only in areas where the floor is suitably reinforced.

It must also be added that, as is known, in the case of cable-operated exercising machines where the user operates the cable indirectly by means of a lever, each user must perform beforehand certain adjustments in order to personalise the machine before being able to use it properly, i.e. in order to grip the lever in a given position, at a certain distance from the fulcrum. Otherwise, the user will find the machine unsuitable and, in addition to losing the time needed to set the machine to structural parameters appropriate for his/her physical size, risks suffering, in the event of imprecise adjustment, serious injury as a result of stressing his/her physical/muscular structure in a physiologically inappropriate manner. In addition, these adjustments may not be easy to carry out, both because, in order to perform them correctly, it is necessary to have a clear idea of the notions as to how the muscles and limbs of our body work and because, on occasions, the adjustments may be complicated for users which are not familiar with the mechanisms present on the machine, as, for example, in the case of the functional machines of the type described with reference to the already mentioned patent U.S. Pat. No. 6,387,020 and the PCT application WO 01/66195. These machines have articulated hollow arms inside which the cable passes and terminates in a handle or other apparatus which can be operated by a user. Each of the respective arms supports, at its free end, a pulley which is mounted eccentrically and from which the cable departs in a direction which is constantly tangential to the pulley. This eccentric pulley is mounted rotatably on the arm and is mechanically balanced by means of a counterweight, in order to cancel out the moment of inertia of the pulley and therefore make its presence mechanically invisible for the user. In this type of machine also, which is acclaimed as being simple to use, it is required to perform adjustment of the machine before exercising and this is possible only with a considerable degree of constructional complexity. For example, it is possible to imagine the problems encountered should a broken cable need replacing and the complex operation required to disassemble at least one part of the machine.

Owing to the plurality of problems described above, cable-operated exercising machines both of the conventional type and of the functional type are not easy to operate and the exercises which may be performed on these machines reproduce only partly the physiological movements and load patterns which occur every day during the practice of respective sporting or working activities. Therefore, cable-operated exercising machines may be improved in several respects.

The object of the present invention is to provide an exercising machine in which the operating apparatus to which the user applies force and the resistive load are connected together by a flexible cable, where the above-mentioned problems are no longer present and where the user is provided with a novel and different approach to muscular exercise in both the sports sector and working sector owing to the adoption of an innovative structural configuration.

A further object of the present invention is to provide an exercising machine where it is possible to perform movements in association with an operating apparatus subject to the constant action of a force couple so as to exercise constantly agonistic and antagonistic muscle groups, thereby converting the notion of a repetitive exercising action into the notion of an exercising movement.

A further object of the present invention is to provide a cable-operated exercising machine which allows immediate use thereof, dispensing with settings performed before use, and is provided with at least one user interface/operating apparatus, the physiologically correct position of which can be easily determined.

A further object of the present invention is to provide a cable-operated exercising machine where the position of the operating apparatus may be selectively modified along a section of cable during the course of exercising so as to ensure constant uniformity between the operating condition and the postures assumed by the user in each particular moment.

SUMMARY OF THE INVENTION

According to the present invention an exercising machine having the characteristic features described in Claim 1 and the following claims is provided.

As a result of the objects achieved by means of the solution of the present invention, investment in a cable-operated exercising machine becomes an attractive proposition because the exercising movement will be more familiar both to persons exercising in a gym for the first time and to athletes who are able to gain advantage from performing exercises which are as similar as possible to the movements which they perform during their own sporting or working activity, where it is required to exercise a given muscle group.

BRIEF DESCRIPTION OF THE DRAWINGS

The invention will now be described with reference to the accompanying drawings which illustrate some non-limiting examples of embodiment thereof, wherein:

FIG. 1 is a schematic side elevation view of a first preferred embodiment of the exercising machine according to the present invention;

FIG. 2 is a schematic side elevation view of a second preferred embodiment of the exercising machine according to the present invention;

FIG. 3 is a front elevation view of a third preferred embodiment of the exercising machine according to the present invention;

DETAILED DESCRIPTION OF THE REFERRED EMBODIMENTS

Figure 4:
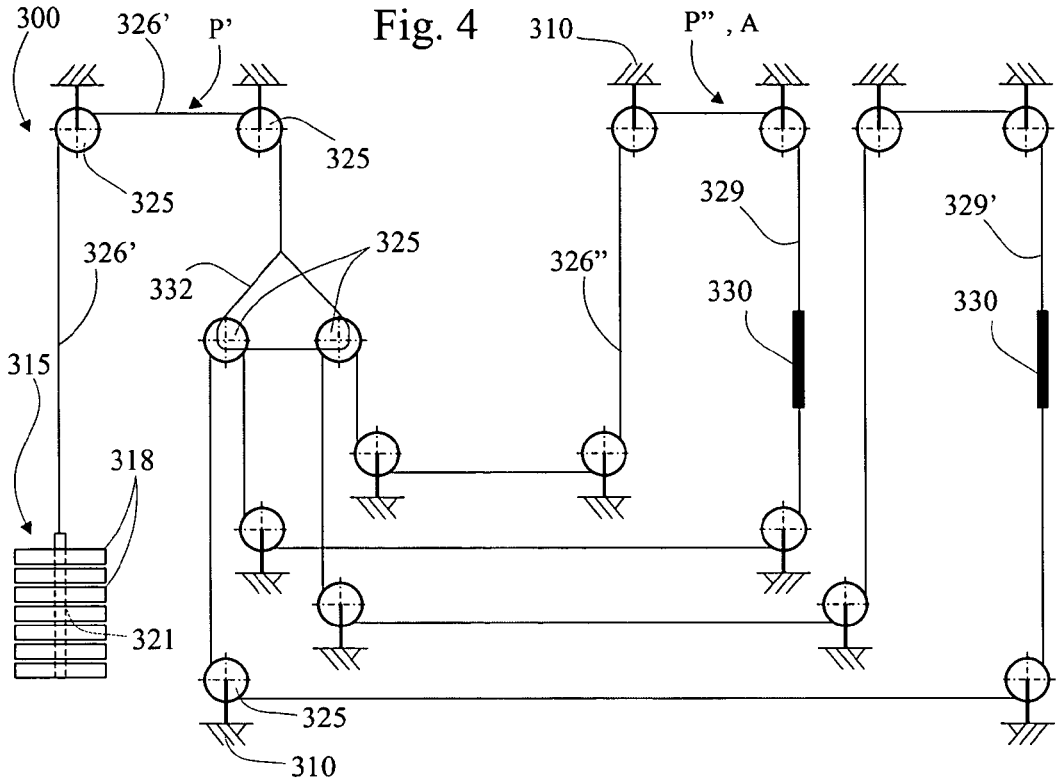
FIG. 4 is a simplified, schematic, side elevation view, with parts removed for the sake of clarity, of a fourth preferred embodiment of the exercising machine according to the present invention.

In FIG. 1, the numeral 1 denotes in its entirety an exercising machine which can be usefully employed to perform training exercises for movements which reproduce the movements typically occurring during working, sporting or muscular rehabilitation activities. This machine 1 is provided with a frame 10 and a load group 15 which is supported by the said frame 10 and consists of at least two load units 16 and 17 which are arranged alongside each other and separate from each other so that they can be operated separately by means of an apparatus 30 which is designed to be used by a user for performing a training exercise and, for this reason, is associated with a cable 26 arranged between the two load units 16 and 17 to which it is connected by means of the respective end portions 27 and 28 situated opposite each other and acting on opposite sides of the apparatus 30. The machine 1 comprises, moreover, a plurality of transmission members consisting of the transmission pulleys 25 shown in FIG. 1 and supported by the frame between the two load units 16 and 17 along a path P which is followed by the cable 26. The path P winds between the pulleys 25 and originates and terminates at the two load units 16 and 17, respectively. The cable 26 may be made equally well of textile, metal or any other kind of fibre and the load units 16 and 17 may be similar to or different from each other and in particular of the gravitational, fluid-dynamic or electromagnetic type or of any other nature, without the choice of the respective type limiting the general nature of the present description. In any case, for the sake of convenience, the two units 16 and 17 used to illustrate the modes of implementing the invention in question are both of the gravitational type and each of these units comprises a plurality of weights 18 which are arranged on top of each other and supported by the frame 10 slidably along a vertical guide for rectilinear movement, which is known and therefore not shown. Each load unit 16 and 17 comprises, moreover, a selection member 21 of the known type and of the type normally used in ordinary counterweight exercising machines. This member 21 comprises a rod 21 provided with a plurality of holes which are transverse to its axis and parallel to each other and each of which is designed to house a pin 22 by means of which a rigid connection between one of the weights 18 and the rod 21 may be selectively established. Therefore, the weight 18, selected by means of the pin 22, is able to act as a support for the weight 18 which are arranged on top of the said selected weight 18. In this way it is possible to adjust the loads at the end portions 27 and/or 28 of the cable 26.

The operating apparatus 30 may be equally well a handle, as shown in FIG. 1, but could also be a belt designed to embrace a person's ankle or any other embodiment of an interface which can be operated by a user. In any case, the apparatus 30 is associated with the cable 26 along a section 29 which is delimited by two pulleys 25' and 25" arranged in succession along the path P and therefore is obviously stressed on respective opposite sides. In particular, the respective pivoting axes 23 of the two pulleys 25' and 25", only one of which has been shown in FIG. 1 for the sake of simplicity, about which the pulleys 25' and 25" rotate as a result of the action of the cable 26, are parallel to each other and the pulleys in question are substantially coplanar with each other. Therefore, the section 29 which is wound around the two pulleys 25' and 25" lies, with its geometric axis, in the (known and not illustrated) plane which passes through (known and not illustrated) races of the pulleys 25' and 25".

Moreover, the handle 30 is arranged between the pulleys 25' and 25" in a given manner on the basis of the user's requirements. In particular, the handle 30 may be connected to the cable in a freely slidable manner so that it can be gripped from a lowered position, visible in FIG. 1, where the handle 30 (shown in solid lines) is arranged by means of gravity in contact with the bottom pulley 25' and may be freely slid along the section 29 into the desired position by the user who intends using the machine 1. With reference to the portion of FIG. 1 shown in broken lines, once the execution of a movement is started, the handle 30 will maintain the reference position along the section 29 of the cable 26 simply owing to the fact that the handle 30 is positioned at the vertex of two separate mutually inclined portions 29' and 29" which the handle 30 itself delimits on the section 29 and along which mutually opposite forces act. Alternatively, it is possible to envisage connecting the handle to the cable 26 in a rigid manner by means of end-of-travel stops 31 (visible schematically only in FIG. 1) which can be fitted to the cable 26 in any manner and on opposite sides of the handle 30 so as to keep the handle 30 in a given position along the section 29.

As regards that illustrated above, owing to the original arrangement of the cable 26 between the two load units 16 and 17, it is possible to keep the cable 26 constantly tensioned by means of the loads selected in the two load units 16 and 17, so as to create a load model which is decidedly original for a weights machine having cables wound around pulleys. These loads may have values which are substantially identical to or different from each other and constant or variable over time, as could be obtained by means of electromagnet load units of the known type, the load level of which could be controlled electrically in a manner definable as required.

The use of the exercising machine can be easily understood from that described above and does not require particular explanations apart from the fact that it differs completely from the cable-operated exercising machines normally encountered.

In fact, when a user of any height approaches the machine 1 and sees the section 29 of cable 26, he/she will be immediately able to carry out an exercising movement by applying a conventional set of movements to the handle 30 adjusted to the height which is most comfortable, without having to perform adjustments beforehand. This has a positive effect on the user, who is able to understand the operating principle of the machine 1 straightaway, without feeling inhibited in any away. For example, the procedure which must be adopted in order to apply to the cable 26 a continuous sequence of pulling and pushing movements using the handle 30 is simple: it is merely required to take hold of the handle 30 in the lowered rest position and move it spontaneously to the height which feels most comfortable from a physiological point of view and then stress the cable as shown in broken lines in FIG. 1 in order to experience a force on the handle 30 which is the resultant of the oppositely acting forces on the two portions 29' and 29" of the section 29 which the handle 30 in each particular instant delimits on the section 29 itself.

As regards that described above, the operating apparatus 30 is always subject to the action of the force exerted by the user and the resultant of the two forces which the two end portions 27 and 28 of the cable 26 exert on opposite sides of the apparatus 30. Therefore, as can be clearly seen from FIG. 1, the apparatus 30 operated by the user's limb is subject to the balanced action of three forces coinciding at a point of the apparatus 30 and coplanar with each other. In particular, of these forces, two are exerted by the cable 26 itself once it has been tensioned by a user using the respective apparatus 30 and are therefore constitutionally coplanar with each other; and the third force is produced by the user so as to balance the resultant force of the two forces described above. Therefore, the force exerted by the user is necessarily coplanar with the latter forces, at least as regards one respective component, independently of the position in which apparatus 30 is situated in a given instant.

From that illustrated above it can be readily deduced that the machine 1 forming the subject of the description provides users with a new and different approach to muscular exercise in both the sports and working sectors owing to its different and innovative structural design. In particular, movements may be carried out on this machine using an apparatus 30 which is constantly subject to the action of a force couple oriented along the cables tensioned by means of the apparatus 30 so as to exercise constantly agonistic and antagonistic muscle groups.

The machine 1 results in the notion of a repetitive exercising action being replaced by the notion of an exercising movement since, with machines of the type described, it is no longer possible to experience an operating condition where no movement energy is required to move the handle 30, and therefore the point of application of the load, unless the frictional component between handle and load is eliminated completely, this being an ideal and therefore unrealisable condition, unless substantially zero resistive loads are set in the two load units 16 and 17.

Moreover, as regards that described above, the machine 1 allows the positioning of the respective handle 30 to be selectively modified by means of sliding along a section 29 of cable 26 even during the course of an exercise, so as to ensure constant uniformity between the operating condition and the postures which the user wishes to assume during various stages of the exercise, so as to be able to adapt to any progression in the exercise when given exercising conditions are achieved.

Finally it is obvious that the exercising machine 1 described and illustrated here may be subject to modifications and variations without thereby departing from the protective scope of the present invention.

Thus it is equally possible for one of the ends 27 or 28 to be kept fixed by blocking one of the respective load units or it may be decided to design a machine 1 in which one of the two ends of the cable is rigidly connected to the frame 10.

Moreover, in the case where it is required for the section 29 to be oriented in a direction other than the vertical direction, it is possible to adapt the path P to this requirement and therefore modify the frame so as to define other pairs of transmission pulleys 25 which are sufficiently spaced to delimit on the cable 26 other sections which are similar to the section 29 of FIG. 1 and on which the handles 130 can be fitted. With reference to this embodiment it is pointed out that, unless otherwise indicated, the reference numbers of the components illustrated in FIG. 2 are the same as those of the corresponding components in FIG. 1, increased by 100. For example, with reference to FIG. 2, in a machine 100, it has been thought to lengthen a bottom longitudinal member 111 of the respective frame 110 and replace the transmission pulleys 25 of the machine 1 in FIG. 1 which delimit the section 129 with articulated transmission members 140, so as to form on the cable 126 a bottom section 129'. The same has been done with an upper longitudinal member 112 of the frame 110. In this way, the machine 100 has three sections: a vertical section 129, bottom horizontal section 129' and upper horizontal section 129", each of which is provided with a respective handle 130 which is fitted in a freely slidable manner between the respective transmission members 140 and can therefore be used in a similar manner to the handle 30 on the section 29 of the machine 1.

Each of the transmission members 140 has a bracket 141 which is rotatably mounted on the frame 110 about an axis 142 oriented in a given manner—horizontally in FIG. 2—and which supports two pulleys 125 coplanar with each other. With reference to the articulated transmission members 140 supported by the bottom longitudinal member 11 of the frame 110, the axis 142 is coaxial with a section of the path P so that the cable 126 leaving the transmission members 140 may be gripped and pulled by means of the handle 130, but also freely rotated about the axis 142 as if cable 126, tensioned by the load, were a crank. The same is also applicable to the upper longitudinal member 112 and the associated articulated transmission members 140.

It must be noted that the transmission members 140 mounted on the longitudinal members 111 and 112 in FIG. 2 have been shown horizontal only for the sake of convenience, since the frame 110 has been formed in the manner of a "C" for the sake of simplicity. Obviously, machines provided with transmission members 140 arranged at different heights, and therefore sections 129, 129' and 129" of cable 126 arranged, when at rest, inclined in a different given manner, also fall within the scope of the present invention.

FIG. 3 shows a machine 200 which has been developed from the machine in FIG. 1 and which comprises a pair of machines 1 which are arranged alongside each other. With reference to this embodiment it is pointed out that, unless otherwise indicated, the reference numbers of the components shown in FIG. 2 are the same as those of the corresponding components of FIG. 1, increased by 200. It should be noted that the machines 1 in FIG. 1 have been modified and the pulleys have been replaced with transmission members 240 which are substantially identical to the transmission members 140 of the machine 100 in FIG. 2. The two machines 200 have been arranged alongside each other so as to offer the user the possibility of exercising simultaneously the arms or the legs by means of a pair of operating apparatuses 230 which are shown for the sake of simplicity in the form of a handle in FIG. 3. The two frames have been replaced by a single frame 210.

Obviously, the characteristic features and the operating procedures of the machines 100 and 200 remain unchanged with respect to that described in connection with the machine 1.

For the sake of completeness, again with the aim of minimising the inertia associated with the load, simplifying the adjustment of the latter and providing further ways of applying the notions described above, another four variants of the machine 1 are provided, each of said variants being described with reference solely to the load group, the respective pulleys, the respective user interfaces and the cable or cables which connect the user interfaces and the load group together. Unless otherwise indicated in the description of each embodiment, the reference numbers of the components illustrated in FIGS. 4 to 7 are the same as those of the corresponding components in FIG. 1, increased, respectively, by 300, 400, 500 and 600. All the versions illustrated in FIGS. 4 to 7 comprise the respective handles 330, 430, 530 and 630 rigidly connected to the respective cable 326, 426, 526 and 626.

With reference to FIG. 4, the machine 300 differs from the machines 1, 100 and 200 owing to the fact that it has a load group 315 provided with a single set of weights 318. The path P in FIG. 1 is divided into two sections P' and P" separate from each other by a transmission member 332 provided with pulleys 325, a respective cable portion corresponding to each section P' and P". In particular, the path P' is of the open type, is formed in the manner of an overturned "L" and is traced by a cable 326' which connects the load group 315 to the transmission member 332, while the path P" is of the type comprising two intersecting loops A and is traced by a single cable 326". The cable 326" has two sections 329 and 329' which are separate from and parallel to each other, each of said sections supporting a respective handle 330.

As regards that described above, the load group 315 comprising a single set of weights 318 is able to act on two handles 330 which are independent of each other by means of a double hoist provided with a pair of handles 330 arranged rigidly along the cable 326" which traces a path P" in the form of double loop A. In this case, by displacing, during use, each handle 330 transversely with respect to the respective rest position, each handle 330 is subject to a force equal to ¼ of the total load selected, so that, for the same lifting effort applied compared to a direct-transmission machine 1, the user performing exercises with both limbs exerts with each limb a force equal to ½ the load, and this force is balanced in two incidental directions and therefore by amounts which may be identical to or different from each other depending on the conditions of use between the upper portion and bottom portion of the cable 326" corresponding to each handle 330.

Figure 5:
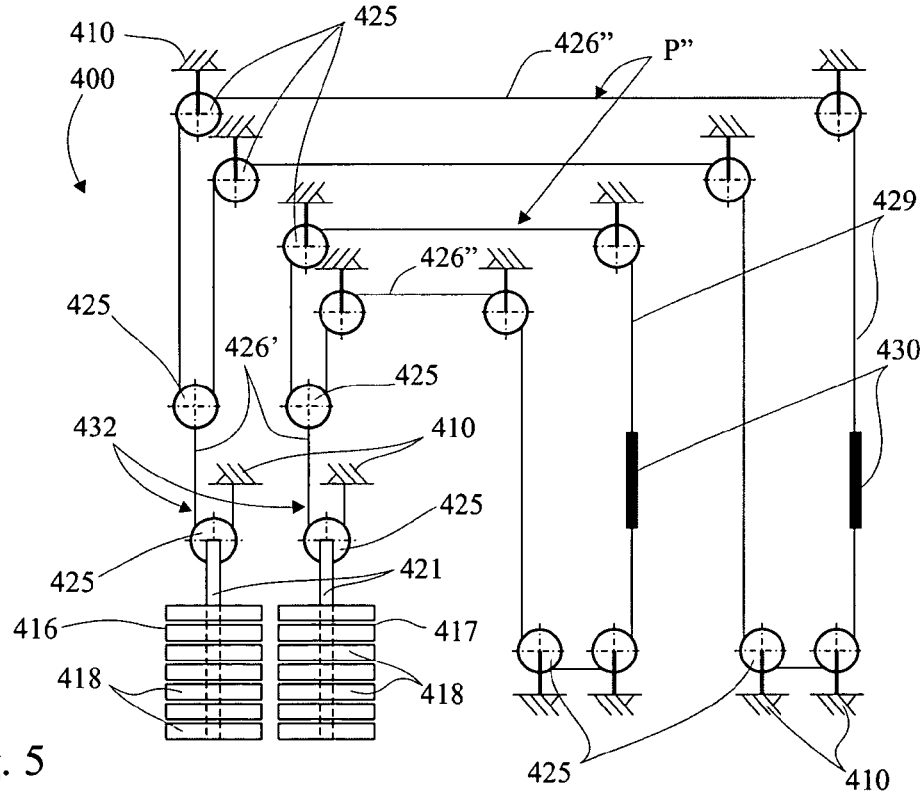
FIG. 5 is a simplified, schematic, side elevation view, with parts removed for the sake of clarity, of a fifth preferred embodiment of the exercising machine according to the present invention.

With reference to FIG. 5, the machine 400 differs from the machine 300 in that the path P" in the form of an intersecting double loop is, in turn, divided into two loops A which are independent of each other and to each of which a path P' corresponds. Therefore, the cable 326" of the machine 300 has been replaced by two separate cables 426" in the form of a loop, each of which is provided with a handle 430, and the cable 326' has been replaced by two cables 426', each of which is able to actuate one of the two load units 416 and 417 by means of a respective rod 421 which acts as a member for selecting the weights 418. The transmission member 332 of the machine 300 is also divided into two parts so as to create a pair of simple hoists 432 comprising a movable pulley 425, one of the load units 416 and 417 corresponding to each hoist 432. The movable pulley 425 of each hoist 432 supports a load selection rod 421.

Therefore, each cable 426" is connected to the rod 421 of the respective load unit 416 and 417 by means of a respective hoist 432 arranged in between, and each cable 426' has one end 427 which is rigidly fixed to the frame 410 and the remaining end 428 connected to the respective cable 426" by means of a movable pulley 425 which corresponds to the annular path P". Conventionally, the frame 410 has been represented by three lines inclined on a horizontal line. In this way, the machine 400 may also be regarded as being a combination of two structures substantially identical to each other and able to operate independently of each other, in a similar manner to the machine 200.

In this case, a force equal to ½ the load set in the respective load unit 416/417 acts on each end of a handle 430, so that it is possible to select different loads for each handle 430.

Figure 6:
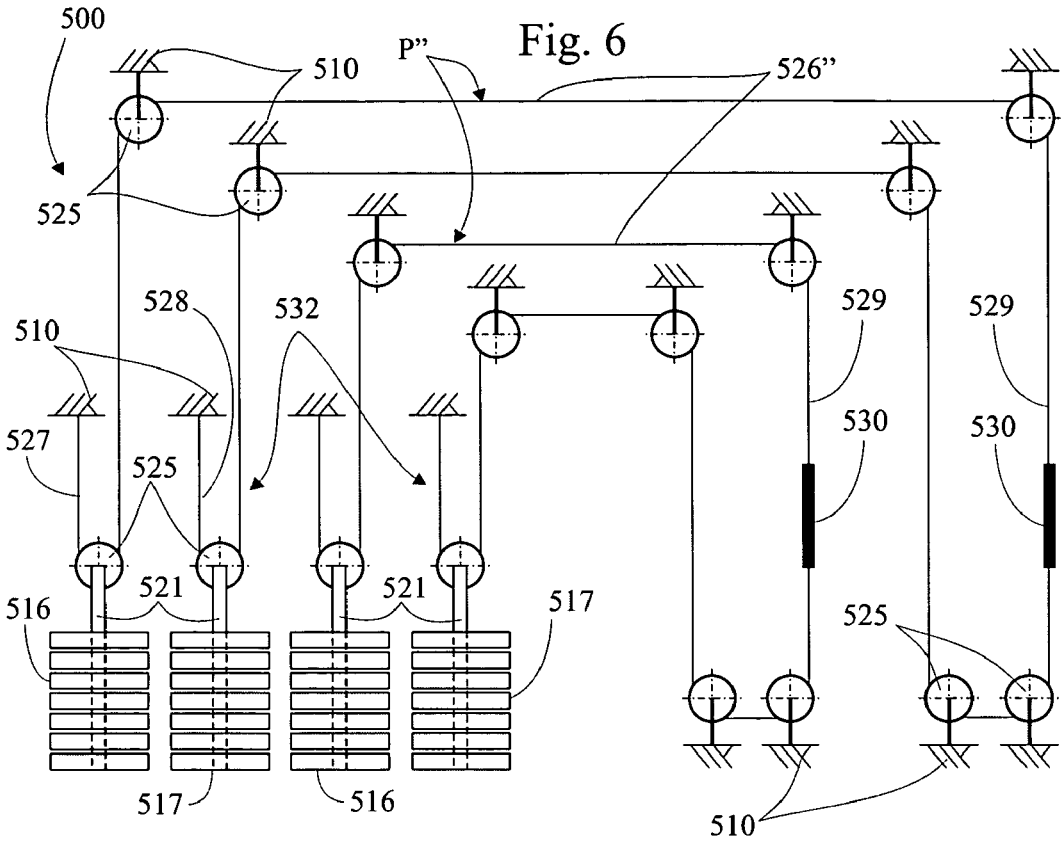
FIG. 6 is a simplified, schematic, side elevation view, with parts removed for the sake of clarity, of a sixth preferred embodiment of the exercising machine according to the present invention.

The machine 500 in FIG. 6 represents a variant of the machine 400 and is derived from the latter by means of division of the load units 416 and 417 belonging to the respective load group 415. Therefore each load group 515 has four sets of weights 518 each of which has a corresponding rod 521 supported by a movable pulley 525 of a hoist 532. Both the respective ends 527 and 528 of each cable 526" are connected to the frame 510. In this case a single path P corresponds to each cable 526", in a similar manner to the examples in FIGS. 1, 2 and 3. Obviously, each load unit of the four available may be set with a different load and therefore the ends of the handles 530 may be subject to the action of different loads. In any case, for each load unit, the reduction in force introduced by each hoist 532 is equal to ½.

From a careful comparison of FIG. 3 and FIG. 6 it can be deduced that the machine 500 may also be derived from the machine 200 by connecting together the each load unit 516/517 and the rod 521 via the hoist 532.

Figure 7:
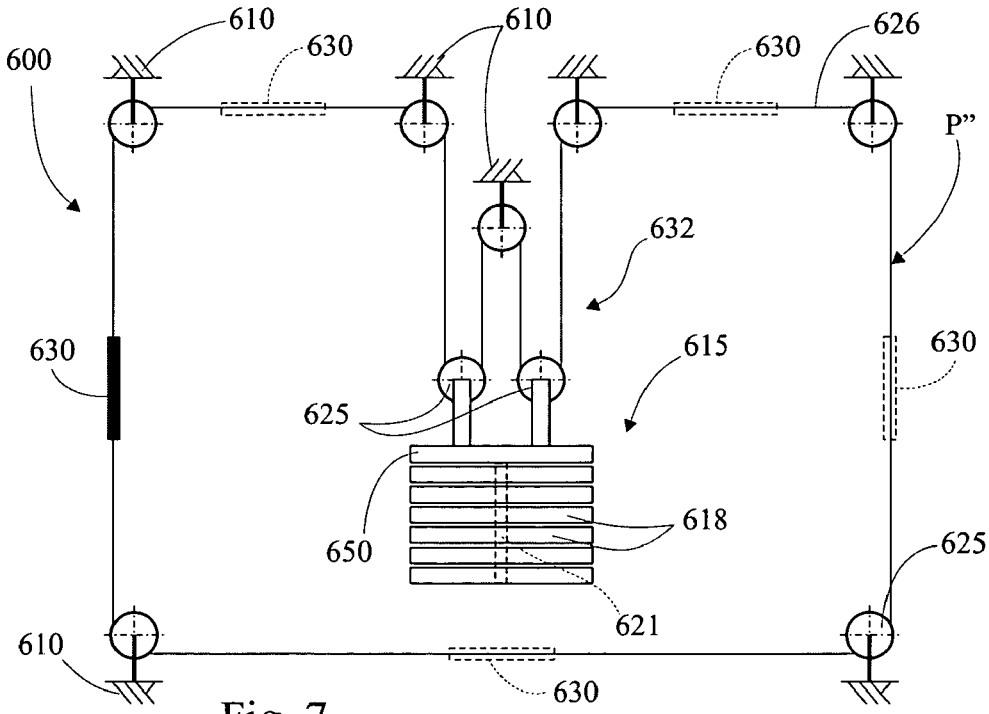
FIG. 7 is a simplified, schematic, side elevation view, with parts removed for the sake of clarity, of a seventh preferred embodiment of the exercising machine according to the present invention.

According to FIG. 7, the load group 615 of the machine 600 comprises a single set of weights 618 and a single cable 626 wound in a loop around a plurality of pulleys 625. Of the latter, two pulleys 625 are hung by means of the cable 626 from three pulleys 625 which are fixed with respect to the frame 610 and support a plate 650 which has at the bottom the load selection rod 621. Therefore, the two pulleys 625 supported by the cable 626 are able to be displaced vertically together with the said rod 621, while remaining freely rotatable about the respective axes of rotation so as to define a double hoist 632. The cable 626 has more than one rectilinear external section and in particular two vertical sections and three horizontal sections, each of which could be provided with a respective handle 630. Intentionally, only one handle 630 has been shown visibly in FIG. 7, while the remaining 4 handles have been shown in broken lines in order to indicate in graphic form the option of being able to choose the cable section with which the handle 630 may be associated.

As regards that described above, the machine 600 may also be imagined as being a version of the machine 400 where the two load units 416 and 417 are combined as one so as to produce the load unit 615, the two single hoists 432 of the machine 400 are combined into one double hoist 632 and two of the fixed pulleys 425 of the independent loops A are combined into one only so as to define a single loop path P traced by the single cable 426.

With reference to FIGS. 4 to 7, it should be specified that the handles 330, 430, 530, 630 may have the respective cables 326", 426", 526" and 626 passing through them and be rigidly connected to the latter in a permanent manner or may be rigidly connected to the respective cables by means of respective end portions.

In this case each handle 330, 430, 530, 630 will constitute a interruption in the respective cable 326", 426", 526" and 626 which will have respective end portions each connected rigidly to one end of the said handle. Therefore, in the case of FIGS. 4 to 7, each handle 330, 430, 530, 630 interrupts the respective cable 326", 426", 526" and 626 and, from another point of view, forms an integral part of the respective path P", joining together two portions of the respective cable 326", 426", 526" and 626, which portions are aligned with each other.

What is claimed is:

1. An exercising machine comprising:

a frame;

at least one operating apparatus for performing a physical exercise;

at least one load group supported by the frame;

at least one cable for connecting the at least one load group with the at least one operating apparatus; and a plurality of transmission members supported by the frame and defining a path of the cable, the operating apparatus being displaceable between two consecutive transmission members to a desired position, the cable path including at least one exercising section defined by the two consecutive transmission members, the two consecutive transmission members being supported by the frame at respective fixed positions for rotation about respective axes extending transverse to respective pivot axes of the two consecutive transmission members to provide for rotational movement of the at least one exercising section about the transverse axes, wherein each at least one operating apparatus comprises a straight handle shaped to be gripped in a hand of a user, with the respective straight handle being connected with a respective at least one cable and with the respective straight handle being connected to said at least one cable to allow said respective handle to slide freely along the respective at least one cable for accommodating the user's work-out requirements.

2. An exercising machine as claimed in claim 1, wherein the at least one exercising section is oriented in a vertical direction.

3. An exercising machine as claimed in claim 1, wherein the at least one exercising section is oriented in a horizontal direction.

4. An exercising machine as claimed in claim 2, further comprising at least one further exercising section oriented in a horizontal direction.

5. An exercising machine as claimed in claim 1, wherein the at least one load group comprises at least one load unit having adjustable load values.

* * * * *